US005809793A

United States Patent [19]

Shutt et al.

[11] Patent Number: 5,809,793

[45] Date of Patent: Sep. 22, 1998

[54] TIMER CIRCUIT FOR HEATING OR AIR CONDITIONER UNIT

[75] Inventors: Richard W. Shutt, Pennellville; Kenneth C. Volz, West Monroe; Donald D. Martell, Central Square; Jerome R. Mullaly, Baldwinsville, all of N.Y.

[73] Assignee: SSAC Inc., Baldwinsville, N.Y.

[21] Appl. No.: 766,586

[22] Filed: Dec. 12, 1996

[51] Int. Cl.[6] ..... F25D 17/06

[52] U.S. Cl. ..... 62/158; 62/182

[58] Field of Search ..... 62/158, 180, 157, 62/234, 230, 182, 186, 179, 181, 231

[56] References Cited

U.S. PATENT DOCUMENTS

| | | | |
|---|---|---|---|
| 3,796,061 | 3/1974 | Weihl . | |
| 3,796,892 | 3/1974 | Stewart . | |
| 3,817,052 | 6/1974 | Connelly et al. . | |
| 3,864,611 | 2/1975 | Chang | 62/158 X |
| 3,946,574 | 3/1976 | Portera | 62/158 |
| 4,034,570 | 7/1977 | Anderson et al. | 62/158 |
| 4,102,389 | 7/1978 | Wills | 62/158 X |
| 4,128,854 | 12/1978 | Ruminsky . | |
| 4,941,325 | 7/1990 | Nuding | 62/158 X |
| 5,142,880 | 9/1992 | Bellis | 62/182 |
| 5,216,897 | 6/1993 | Tsuchiyama . | |
| 5,218,837 | 6/1993 | Moore . | |
| 5,227,981 | 7/1993 | Katsuki et al. . | |
| 5,377,497 | 1/1995 | Powell . | |
| 5,455,469 | 10/1995 | Ward . | |

*Primary Examiner*—Harry B. Tanner
*Attorney, Agent, or Firm*—Wall Marjama & Bilinski

[57] ABSTRACT

The invention is an improved timer circuit for operating a heating or air conditioning unit which utilizes a single time delay generating circuit for delaying operation of both a compressor and a unit fan under certain operating conditions. A logic circuit for operating a fan relay is made responsive to the thermostat output and a time delay generating circuit output so that the fan relay is de-energized only in the case that the compressor has been turned off for at least the duration of a time delay generator timing period, and is in a state commensurate with a satisfactory building temperature. When the timer circuit is used in large-scale heating or air conditioning systems, the timing period of each timing circuit can be adjusted to a different duration so that a voltage lag problem on start up is avoided.

18 Claims, 4 Drawing Sheets

TIMER CIRCUIT FOR HEATING OR AIR CONDITIONER UNIT

BACKGROUND OF THE INVENTION

1. Field of the Invention

This invention relates to heating and/or air conditioning climate control systems in general and in particular to a method and associated circuit apparatus for operating a heating or air conditioning unit of a climate control system.

2 Background of the Prior Art

A compressor of an air conditioning and/or heating climate control system is a sensitive equipment article which is subject to failure under certain operating conditions.

The possibility of compressor failure exists, for example, where there is a premature attempt to restart a compressor motor after a motor shut off. Starting a compressor motor too quickly after stoppage may result in a stalled locked rotor condition. In the case of a scroll compressor, restarting a compressor too quickly may result in the compressor running in reverse.

The inventors of the present invention have noted another possible operating condition which may result in compressor motor failure. In the case of a large-scale climate control system having a plurality of individual compressor units, the inventors have postulated a danger of a voltage sag if there is an attempt to start each compressor motor simultaneously, for example, after a power failure.

A common prior art circuit apparatus for protecting a compressor provides for a start delay each time there is a call for a compressor motor activation. This timing method solves the premature restart problem, since the compressor motor can be operated safely if it is restarted a sufficient time after it is shut down. However, the method also reduces performance since the compressor remains idle during times when there is a need for operation and the compressor can be operated safely.

There exists a need for a climate control system operating method and apparatus which addresses possible operational problems not addressed in prior art methods without reducing performance of the system.

SUMMARY OF THE INVENTION

According to its major aspects and broadly stated, the present invention is a method and associated circuit apparatus for operating an air conditioning or heating system having at least one unit compressor.

In general, a compressor in an air conditioning or heating unit system increases the temperature and pressure of refrigerant flowing in a refrigerant loop. An air conditioning or heating system may also include a unit fan for forcing air over a heating or cooling element of the climate control system, and into a building interior.

In the present invention, one time delay generating circuit is adapted to provide a plurality of different functions. In one embodiment, a timer circuit is adapted to commence a timing period either in the case of a compressor shut down or in the case of a power regain after a power failure. In this way one time delay circuit provides the dual functions of compressor lockout and of start up delay. In another embodiment of the invention, a timer circuit according to the invention is adapted to delay shut down of a unit fan after a compressor shut off in addition to providing at least one of the above functions.

In one specific embodiment of the invention, a compressor relay for activating a compressor is arranged in series with a thermostat contact and an output contact of a time delay generating unit. A voltage source, in turn, is arranged in parallel across the series connected thermostat contact, timer output contact, and compressor relay. When the building air temperature reaches a satisfactory level, the thermostat contact opens to cut off the path for current energizing the compressor relay, and power is instead applied the time delay generating circuit to commence a timing period.

For the duration of the timing period, the output of the time delay generating unit is open, and thus operates to lock out energizing of the compressor motor relay in the case where the thermostat contact closes during the timing period. The compressor is thereby prevented from being restarted prematurely after it is shut down.

When the timing period ends, the output contact of the time delay generating unit closes to enable immediate energizing of the compressor relay in the case where the thermostat closes after the timing period has elapsed. The timing circuit includes circuit elements which enable the contacts of the time delay generating circuit to remain closed after the thermostat contact closes, despite the fact that the power supply is removed from the time delay generating circuit when the thermostat contact closes.

Because the timing period in the above described embodiment is adapted to begin when power is supplied across the time delay generating unit, the timing circuit of the invention can be made responsive to a regaining of power after a power failure. That is, a timing circuit of the invention can be made to delay operation of a compressor when there is a regaining of power after a power failure in addition to locking out compressor operation for the duration of a timer period after a compressor shut down.

In addition to one or both of the above functions, the time delay generating circuit of the invention can also be made to control operation of a unit fan for blowing air across a heating or cooling element. It is desirable to maintain a unit fan on for a predetermined time after compressor shut off to move standing air in a heating or cooling unit into a building.

To the end that the unit fan remains on for a predetermined time after compressor shutdown, a fan relay is arranged in series with a fan output contact of a fan logic circuit and the series connected fan relay contact and fan relay are connected in parallel with a power source so that opening of the fan output contact shuts off the fan relay. The fan logic circuit is made to open the fan contact only in the case where the compressor is off and the timing period has ended. The timing period for operation of the fan can easily be adjusted to a different duration then the timing period for compressor lockout.

In one embodiment, the fan logic circuit is provided by a control signal generating circuit that is responsive to a power supply. The control signal generator generates a control signal when the power supply is charged, but does not generate a control signal when the power supply is deactivated. When the thermostat contact closes, the terminals of the control signal power supply are at equal potential and no control signal is generated. When the thermostat contact is open and the timing contact is closed (corresponding to the condition that the compressor is off and the timing period has elapsed) the resulting potential across the control signal power supply generates a control signal which is input to the fan switch circuit to open the fan contact thereby shutting off the unit fan.

Large-scale heating or air conditioning systems typically have a plurality of climate control units, each having an individual unit compressor and a unit fan. A timing circuit of the invention for controlling operation of each unit's compressor and fan is provided for each unit.

In accordance with another aspect of the invention, the timing period of each timing circuit of a plurality of timing circuits in a heating or air conditioning system is adjusted to be different time delay than every other timing circuit of the system. In this way, there is no simultaneous activation of several motor compressors at once, and the power lag problem is avoided.

These and other features and advantages of the invention will become clear from a reading of the ensuing Detailed Description in connection with the referenced drawings.

BRIEF DESCRIPTION OF THE DRAWINGS

In the drawings, wherein like numerals are used to indicate the same elements throughout the views.

DETAILED DESCRIPTION OF THE PREFERRED EMBODIMENTS

The invention is a timing circuit for controlling operation of a compressor and a unit fan in air conditioning and/or heating unit having a unit compressor for increasing the pressure and temperature of refrigerant flowing in a refrigerant loop, and a system fan for blowing air over a heating or cooling element into a building. As skilled artisans will easily recognize, the timing circuit can be adapted for any climate control system having at least one compressor and fan, including, for example, a heat pump combination heating and cooling system. The invention can also be adapted for use with many other types of large industrial equipment articles requiring delayed operation.

Figure 1:
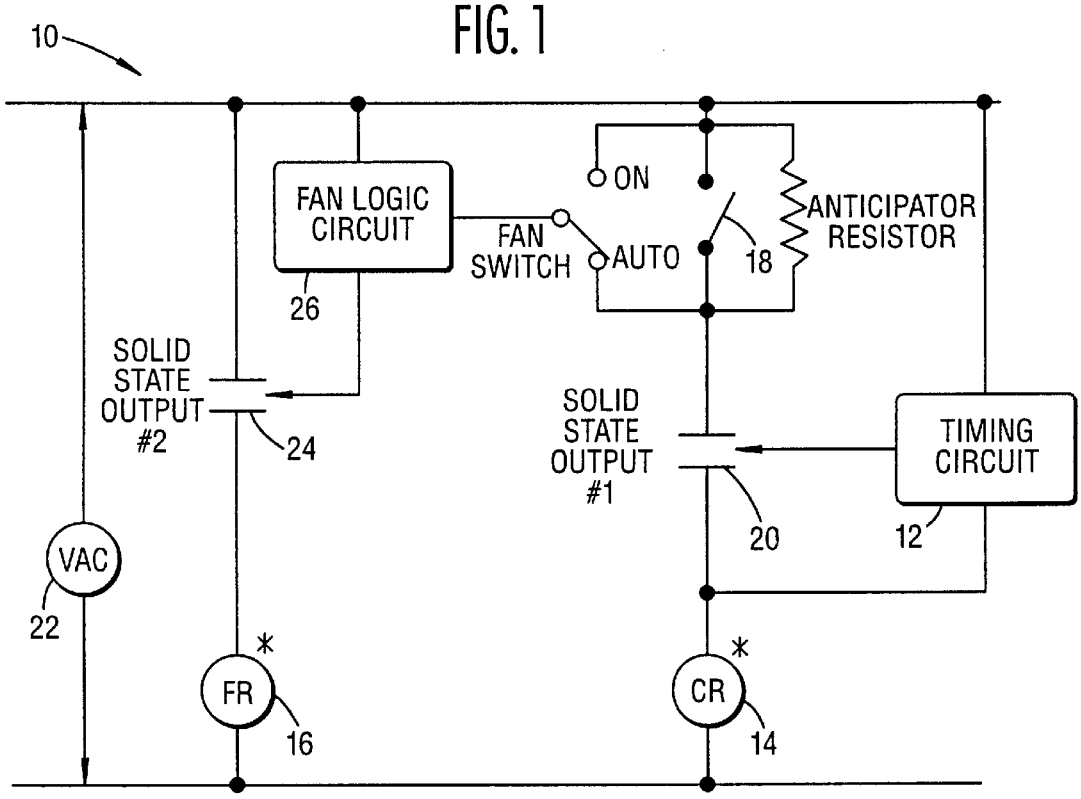
FIG. 1 is a simplified block diagram of a timer circuit according to the invention.

In the present invention, as shown is simplified block diagram of FIG. 1, timing circuit 10 includes time delay generating circuit 12 which is adapted to control operation of both a compressor, activated by energizing compressor relay 14 and a unit fan, activation by energizing fan relay 16 according to a predetermined timing scheme.

In one preferred embodiment of the invention, compressor relay 14 for activating a compressor (not shown) is arranged in series with a thermostat contact 18 and a timer output contact 20 of time delay generating unit 12. Power source 22 is applied across the series connected thermostat and timer output contacts 18 and 20 and compressor relay 14 so that power source 22 supplies power to compressor relay 14 when thermostat and timer output contacts 18 and 20 are closed. Power source 22 supplies power to time delay generating circuit 12 when either one of contacts 18 or 20 is open.

When the building air temperature reaches a satisfactory level, thermostat contact 18 opens to cut off the path for current energizing the compressor relay 14, and power is applied the time delay generating circuit 12 to commence a timing period. Time delay generating circuit 12 is adapted to open timing contact 20 when power is supplied thereto. Timing contact 20 will remain open for the duration of a timing period of predetermined duration, and then close.

When timing contact 20 is open, contact 20 operates to lock out energizing of the compressor motor relay in the case where the thermostat contact closes during the timing period. In this way, the compressor is prevented from being restarted prematurely after it is shut down.

When the timing period ends, timer contact 20 closes. After timer contact 20 closes, compressor relay 14 is energized immediately on subsequent closure of thermostat contact. This feature provides for improved performance since the compressor is not prevented from operating when it can be operated safely as in fixed delay prior art timer circuits. Timing circuit 10 includes circuit elements which enable timer contact 20 to remain closed after the thermostat contact closes, despite the fact that the power supply is removed from time delay generating circuit 12 when thermostat contact 20 closes.

In accordance with the invention, time delay generating circuit 12 is made in addition to control operation of a unit fan for blowing air across a heating or cooling element. It is desirable to maintain a unit fan on for a predetermined time after compressor shutdown in order to move standing air inside a heating or cooling unit into a building.

To the end that the unit fan remains on for a predetermined time after compressor shutdown, fan relay 16 is arranged in series with fan output contact 24 controlled at fan logic circuit 26 and the series-connected fan relay 16 and contact 24 are connected in parallel with a power source 22 so that opening of the fan output contact 24 shuts off fan relay 16. Fan logic circuit 26 opens contact 24 to deenergize fan relay 26 during automatic operation only in the event that the compressor is off and the timing period has elapsed.

Figure 2:
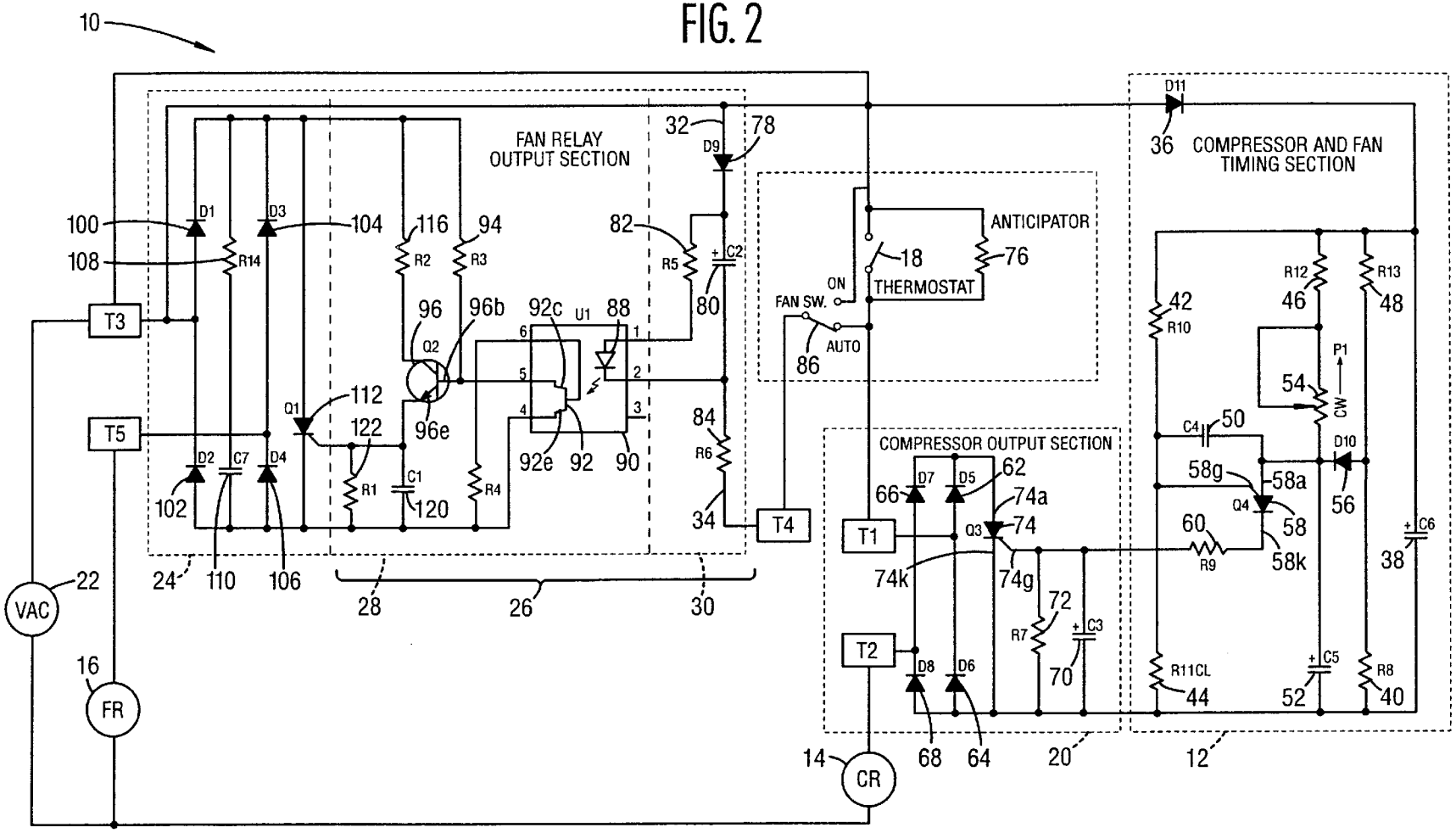
FIG. 2 is a detailed schematic diagram of a specific embodiment of a timer circuit according to the invention.

Logic circuit 26 may be provided by a control signal generating circuit 28 which is powered by a chargeable switch power supply 30 as seen in the specific circuit diagram example shown in FIG. 2. Control signal generating circuit 28 is adapted to generate a control signal when power supply 30 is active. For providing logic circuit, chargeable switch power supply 30 may be connected in parallel across thermostat contact 18. When thermostat contact 18 is closed, terminals 32 and 34 of switch power supply 30 are at equal potential and no control signal is generated. When thermostat contact 18 is open and timing contact 20 is closed (corresponding to the condition that the compressor is off and the timing period has elapsed) there is a potential across the control signal power supply 30 and a switch control signal is generated. The switch control signal is input to the fan contact, preferably a solid state contact, to open fan contact 24 and thereby deenergize fan relay 16.

Because the timing period in the above described embodiment is adapted to begin when power is supplied across time delay generating unit 12, the timing circuit of the invention can be made responsive to a regaining of power after a power failure. That is, timing circuit 10 of the invention can be made to delay operation of a compressor when there is a regaining of power after a power failure in addition to locking out compressor operation for the duration of a timer period after a compressor shut down.

The timing period of the time delay generating circuit may be adjusted by selection of circuit components or by adjusting a variable circuit component or components integrated into the timing circuit. Normally, the timing period is adjusted by adjusting resistive or capacitive elements affecting an RC time constant.

Large-scale heating or air conditioning systems typically have a plurality of heating or air conditioning climate control units, each having an individual unit compressor and a unit fan. A timing circuit 10 of the invention for controlling operation of each unit's compressor and fan is provided for each unit.

In accordance with another aspect of the invention, the timing period of each timing circuit in an air conditioning or heating system having a plurality of timing circuits is adjusted to be different time delay than every other timing circuit of the system. In this way, there is no simultaneous activation of several motor compressors at once, and the power lag problem referenced in the background section of the application is avoided.

A specific embodiment of the invention is shown in FIG. 2. A power supply for supplying power to time delay generating circuit 12 is provided by diode 36 and capacitor 38 which form a half wave rectified filtered DC power supply. Time delay generating circuit 12 comprises resistors 40, 42, 44, 46 and 48, capacitors 50 and 52, trimmer potentiometer 54 (which may also be a fixed resistor), diode 56 and programmable unijunction transistor (PUT) 58, which is preferred over alternative switching devices because of its lower cost and easily adjusted reference voltage. The reference voltage for gate 58*g* of PUT 58 is established by the voltage divider formed by resistors 42 and 44. Capacitor 50, while not required, may be used to prevent unwanted electrical noise from causing an unwanted turn "on" of PUT 58. Resistors 48 and 40 form a voltage divider for precharging timing capacitor 52 to a preset value via conduction of diode 56. Once PUT 58 has been turned "on" the current path through resistor 48 and through diode 56 allows sufficient current to flow through anode 58*a* of PUT 58 such that it will remain in the "on" state.

The timing period required for PUT 58 to turn "on" is determined by the time required for charging of capacitor 52 to about 0.5 volts above the voltage $V_g$ at gate 58*g* of PUT 58, controlled by voltage between voltage divider formed by resistors 42 and 44. This charging time is a function of voltages $V_{c38}$ and $V_{pre}$, resistances of resistor 46 and potentiometer 54 and of the capacitance of capacitor 52. It is seen that the timing period of time delay generator circuit 12 is conveniently adjusted by adjusting potentiometer 54 or another of the parameters affecting the time delay.

When PUT 58 turns "on", current flows from the anode to cathode of PUT 54 through resistor 60 and activates timer output contact 20, which is preferably a solid state type contact. In the example of FIG. 2, timer output contact 20 is provided by full wave bridge rectifier formed by diodes 62, 64, 66, and 68, capacitor 70, resistor 72, and silicon controlled rectifier SCR 74. Contact 20 is closed when current flows through gate 74*g* to cathode 74*k* of SCR 74. The current necessary to maintain SCR 74 in an "on" state is supplied either continuously through PUT 58 in the case where the time delay circuit power supply is charged, or by capacitor 70 if capacitor 70 has been previously charged.

It will now be verified that the time delay generating circuit described in connection with FIG. 2 provides the function of: (1) delaying the starting of a compressor when a voltage source is initially applied to timer circuit 10; (2) locking out operation of a compressor in the case where there is an attempted restart of a compressor within the timing period; and (3) allowing immediate restart of a compressor if there is a call for compressor operation after the compressor timing period has expired.

When power source 22 is initially turned on, either in an initial start-up of a heating or air-conditioning system, or after a power failure, and thermostat contact 18 is closed (signaling a call for compressor operation), timer output contact 20 is open since there is no voltage on capacitor 70. As a result of timer contact 20 being open, power is applied to half wave rectifier formed by diode 36 and capacitor 38 and a timing period begins until PUT 58 turns "on" to supply current to SCR 74 to turn SCR 74 "on", thereby closing contact 20 and energizing compressor relay 14. When SCR 74 is "on" the voltage drop across contact 20 is equal to the voltage drop across the full wave bridge and SCR 74 (approximately 2.5 volts), which is insufficient to maintain PUT 58 in an "on" state. When building temperature reaches a satisfactory level to open thermostat contact 18, power supply formed by diode 36 and capacitor 38 charges again to begin a new timing delay.

When power is applied to the time delay generating circuit 12, SCR 74 is off and timer contact 20 is open during the timing period, but closes when PUT 58 turns "on" to activate contact 20. During the timing period it is seen that the time delay generating circuit 12 works to "lock out" activation of a compressor. If thermostat contact 18 closes during the timing period, compressor relay 14 will not be energized as timer contact will still be open. Once timer contact 18 closes, however, compressor relay 14 is in condition to be energized immediately on a subsequent closing of thermostat contact 18. When thermostat contact 18 and output contact 20 close, time delay generation circuit 12 is no longer supplied with power and PUT 58 turns "off". SCR 74 nevertheless remains "on" during this period to maintain compressor relay 14 energized by way of energy supplied by capacitor 70 which is continuously charged by current flowing through anode 74*a* to gate 74*g* of SCR 74. Because current flows through anticipator resistor 76 and SCR 74 when thermostat contact 18 is open and SCR 74 is "on" the thermostat operates properly, and there is no need for a shunt element across the output of timer contact 20 to operate anticipator resistor 76.

Operation of a fan delay according to the invention will now be described. In general, to remove standing air in a heating or air conditioning unit it is desirable to operate a unit fan for a predetermined time after a compressor is shut down. That is, it is desirable to operate a unit fan at all times unless the compressor is not operating and a timing period has elapsed. Accordingly, logic circuit 26 is adapted to open fan contact 24 to deenergize fan relay 16 in the case where thermostat contact 18 is open and timer contact 20 is closed.

The specific embodiment of logic circuit 26 shown in FIG. 2 includes a control signal generating circuit 28 that is responsive to a chargeable power supply 30. A control signal is generated to open fan contact 24 when power supply 30 is charged but is not generated when power supply 30 is not charged.

Half wave rectified DC power supply, which includes diode 78, capacitor 80, and resistors 82 and 84 is arranged in parallel across thermostat contact 18 with fan switch 86 in an "auto" position. Resistors 82 and 84 form a voltage divider which limits the maximum voltage to which capacitor 80 can charge. It is seen that, when thermostat contact 18 is closed, terminal 32 and 34 will be of equal potential and power supply 30 will not be charged. Power supply 30 will also not be charged if timer contact 20 is open to cut off a current path for current which otherwise would charge power supply 30. It is seen that potential difference between terminals 32 and 34 will appear only if thermostat contact 18 is open and timer contact 20 is closed. This is in accordance with the required logic that the compressor is off and the timing period has elapsed.

When power supply 30 is charged, LED 88 of optocoupler 90 lights up to turn "on" optocoupler output transistor 92. Optocoupler 90 is included to provide isolation between components of fan logic circuit 26 and components of time delay generating circuit 12. In addition to an optical isolator, a mechanical relay, or a transformer, for example, may be used to provide electrical isolation between circuit components of the fan logic circuit and time delay generating circuits.

Continuing with description of logic circuit 26, it is seen that when optotransistor 92 turns "on", current through resistor 94 flows from the collector to, 92*c* emitter 92*e* of optotransistor 92 and not from base 96*b* to emitter 96*e* of transistor 96 as is the case when optotransistor 92 is "off". As a result, current does not flow into fan contact 24 and, subsequently, contact 24 opens.

Fan contact 24, like contact 20 is preferably a solid state contact though both contacts 20 and 24 could be substituted for by a mechanical contact such as a relay contact, though such substitution would normally not be preferred given the relative inexpensiveness of solid state contacts. It is seen that control signal generator 28 and contact 24 could be replaced by a single mechanical relay providing both electrical isolation and contact functions.

With reference again to solid state fan contact 24 it is seen that contact 24 includes a full wave DC bridge rectifier formed by diodes 100, 102, 104, and 106, resistor 108, capacitor 110, and SCR 112. When LED 88 emits light, optotransistor 92 turns "on". As a result, current does not flow into base 96*b* of transistor 96 and instead flows from collector 92*c* to emitter 92*e* of optotransistor 92. When current stops flowing through base 96*b* and emitter 96*e* of transistor 96, SCR 112 of solid state contact 24 turns "off" to open fan contact 24. When LED 88 does not emit light, optotransistor 92 turns "off" and current once again flows through base 96*b* and emitter 96*e* of transistor 96. This causes transistor 96 to turn on, and results in current flowing through resistor 116, and through the collector and emitter of transistor 96 to turn on SCR 112 and close contact 24 thereby energizing fan relay 16. Resistor 108 and capacitor 110 are not required but may be provided to limit the rate of rise of the voltage applied to SCR 112, thereby preventing an erroneous turning "on" of SCR 112.

It is seen then that fan contact 24 is open (and fan relay 16 is de-energized) only in the case that LED 88 emits light. Further, LED emits light only if thermostat contact 18 is open and timer output 20 is closed, the case corresponding to the compressor being off and the timing period being expired. When fan switch 86 is set to an "on" position, it is seen that terminals 32 and 34 are always of equal potential and that LED 88 cannot therefore emit light. Fan relay 16 then is continuously energized when fan switch 86 is in an "on" position.

Time delay generating circuit 12 can be easily adapted so that the timing period for locking out compressor operation of a unit is different than the timing period for operating a unit fan. In the embodiment shown in FIG. 3, an additional switch-activated resistor 202 is provided in parallel across SCR 74 of solid state contact 20. Resistor-controlling transistor 204, may be made responsive to a first timing signal generated by time delay generating circuit and SCR 74 of contact 20 can be made responsive to a second timing signal generated by time delay generating unit 12. If the first and second timing signals have different timing periods, then transistor 204 and SCR 74 are turned "on" at different times.

Resistor 202 of solid state contact 20 should be sized so that current sufficient to cause de-energizing of fan relay 16 flows through contact 20 when transistor 204 is on, but should also be sized so that the flow of current through contact resulting from a subsequent closure of thermostat contact is not sufficient to cause energizing of compressor relay. In one particular embodiment, turning on transistor 204 causes a current to flow through contact 20 that is sufficient to charge power supply 30 of fan logic circuit 26, as seen in FIG. 2, and the compressor relay lockout function is maintained despite the turning on of transistor 204 as long as SCR 74 is off. It is seen that the timing of the compressor lockout function and the fan delay function of the present invention can be controlled by controlling the timing of timing signals generated by time delay generating unit 12. If the first timing signal controlling transistor 204 has a timing period less than that of the second timing signal, then the compressor lockout function will be maintained for a predetermined time after fan shut off in the case of a compressor shut off.

Figure 3:
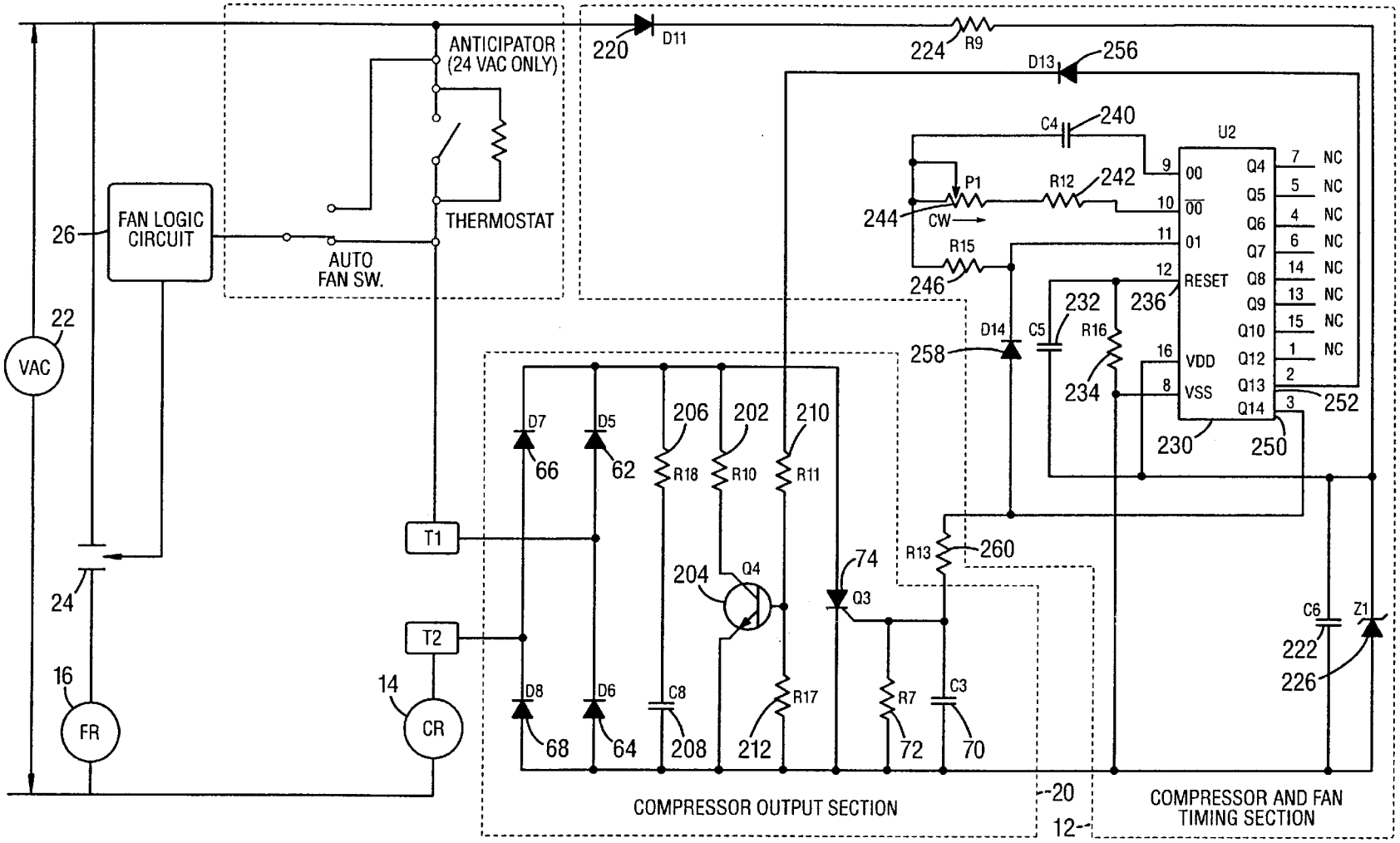
FIG. 3 is a detailed schematic diagram of a specific embodiment of a timer circuit according to the invention having two discreet timing periods for the compressor lockout function and for the fan delay functions, respectively.

In the particular embodiment shown in FIG. 3, having a power supply provided by diode 220, capacitor 222, resistor 224 and zener diode 226, time delay generating unit 12 employs an inexpensive binary counter/divider and oscillator IC 230 (counter) in order to generate discreet first and second timing signals. Discreet first and second timing signals could also be generated using, for example, two separate time delay generating units connected in parallel, each having a different timing period. When power is supplied to the time delay generating unit shown in FIG. 3, voltage of the DC power supply is coupled through capacitor 232 to resistor 234 and reset pin 236 of counter 230. This provides a pulse reset of the counter/divider stages of counter 230. After the decay of the voltage pulse on reset pin 236, the internal inverter section of counter 230 and timing components capacitor 240, resistor 242, and resistor 246 generate a square wave oscillation which is fed internally to the clock input of the counter/divider section of counter 230. The period of oscillation can be adjusted through selection of the timing components 240, 242, 244, 246 and/or by appropriate selection of output pins, e.g. 250, 252 which in general have outputs that change state after a predetermined number of oscillations have occurred, the number of oscillations required to change state varying from pin to pin. The period of oscillation can be conveniently adjusted by adjusting a potentiometer 244 in series with resistor 242.

Figure 4:
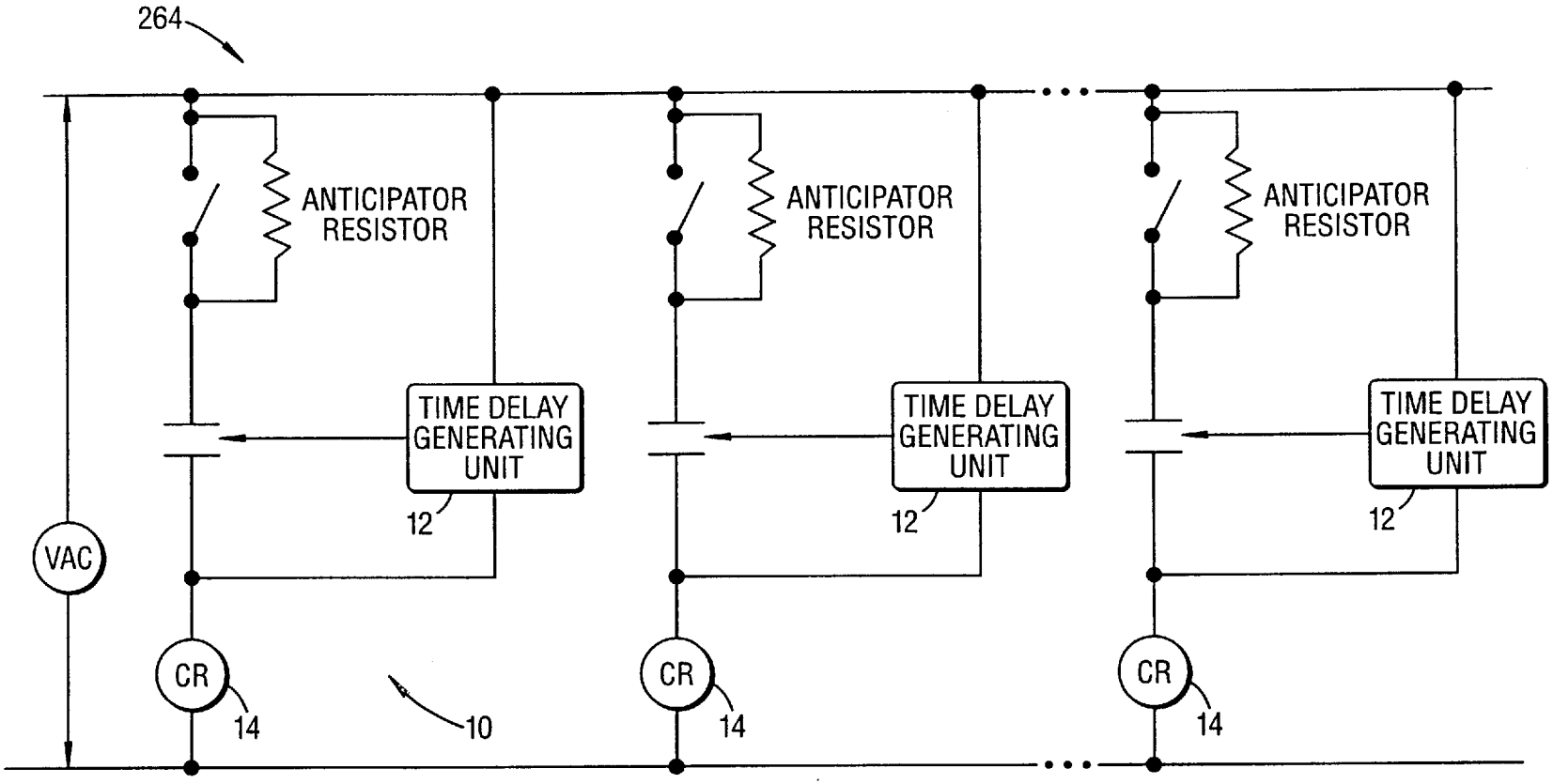
FIG. 4 is a schematic diagram of a control circuit for large-scale heating or air conditioning system having a plurality of individual climate control units, each unit having a separate timing circuit.

Now referring to FIG. 4, a control circuit schematic diagram 264 is shown for a large scale heating or air conditioning system having a plurality of individual heating or air conditioning units, each having associated therewith a time delay generating circuit 12 according to the invention as has been described herein. Each time delay generating unit 12 has associated therewith at least one adjustable timing period which may be adjusted as described in connection with FIGS. 2 and 3. "Adjusting" herein shall refer not only to actual adjustment, e.g. turning a potentiometer such as 244, but also to the step of previously selecting circuit components so that desired timing characteristics are obtained.

In accordance with a method for operating an air conditioning or heating system having a plurality of heating or cooling units, the timing period of each timing circuit is adjusted so that not all circuits have equal timing periods. Preferably the timing period of each timing circuit is adjusted to a period that is distinct from the timing periods of the remaining timing circuits. Typically the timing period of each timing circuit is at least about 2 minutes in duration and at least about 5 seconds different in duration from that of the timing circuit having the most similar timing period.

By configuring each timing circuit to have a different timing period, the compressors of each unit are not started simultaneously when system is initially started up or restarted after a power failure. Therefore, a possible voltage lag problem is avoided, and the compressors of the system are started up safely.

While the present invention has been explained with reference to a number of specific embodiments for the purpose of fully satisfying the requirement that this description set forth the best mode of making and carrying out the present invention, it will be understood that the spirit and scope of the present invention should be determined with reference to the appended claims.

What is claimed is:

1. A timer circuit for controlling operation of a heating or air conditioning unit of the type having a unit compressor and a unit fan, said circuit comprising:

a compressor relay for activating said compressor;

a time delay generating circuit, said time delay generating circuit having a timer output contact adapted to open when said time delay circuit is supplied with power, and to close a predetermined time after said output contact opens, said output contact arranged in series with said compressor motor relay;

a thermostat contact in series with said output contact and with said compressor relay responsive to a temperature of a said building;

a power source arranged in parallel across said series connected thermostat contact, timer output contact and compressor relay so that said power source supplies power to energize said compressor relay when said thermostat and timer contacts are closed and supplies power to said time delay generating circuit when said thermostat contact is open so that said time delay generating circuit begins timing in response either to said thermostat contact opening or to power initially being supplied by said power source;

a fan relay for activating said fan;

a fan output contact arranged in series with said fan relay, said power source being arranged in parallel across said series connected fan relay and said fan output contact so that said fan relay is de-energized when said fan contact is open;

a control signal generating circuit for operating said fan output contact, said control signal generating circuit having a power supply connected in parallel across said thermostat contact so that said power supply is energized when said thermostat is open and said timing contact is closed, said fan output contact being responsive to said power supply so that said fan contact opens when said power supply is energized.

2. The timing circuit of claim 1, wherein said control signal generating circuit includes electrical isolation means for electrically isolating circuit components of said control signal generating circuit from circuit components of said time delay generating circuit.

3. The timing circuit of claim 1, wherein said fan contact is solid state contact.

4. The timer circuit of claim 2, wherein said electrical isolation means includes an optocoupler.

5. The timer circuit of claim 2, wherein said fan contact is a solid state contact, and wherein said electrical isolation means includes an optocoupler.

6. The timer circuit of claim 1, wherein said electrical isolation means includes a transformer.

7. The timer circuit of claim 1, wherein said electrical isolation means includes a mechanical relay.

8. The timer circuit of claim 1, wherein said power supply comprises a diode connected in series with a capacitor.

9. The timer circuit of claim 1, wherein said time delay generating circuit is adapted to generate a fan turn off timing signal, and a compressor operation timing signal, and wherein said output contact is a solid state contact including a bridge rectifier, a series connected resistor-controlling transistor and resistor, and a contact-controlling SCR, said bridge rectifier, said series connected resistor controlling transistor and resistor, and contact controlling SCR being connected in parallel with one another, wherein said resistor-controlling transistor is responsive to said fan turn off timing signal, and wherein said resistor is sized so that when said timing circuit generates said fan turn off timing signal, an amount of current flows through said resistor that is sufficient to energize said power supply of said logic circuit, but is not sufficient to cause energization of said compressor relay.

10. The timer circuit of claim 9, wherein said time delay generating circuit comprises a counter/divider and oscillator integrated circuit.

11. The timer circuit of claim 9, wherein said time delay generating circuit is adapted to generate said compressor operation timing signal a predetermined time after generating said fan turn off timing signal.

12. The timing circuit of claim 9, wherein said control signal generating circuit includes electrical isolation means for electrically isolating circuit components of said control signal generating circuit from circuit components of said time delay generating circuit.

13. The timing circuit of claim 9, wherein said fan contact is solid state contact.

14. The timer circuit of claim 9, wherein said electrical isolation means includes an optocoupler.

15. The timer circuit of claim 9, wherein said fan contact is a solid state contact, and wherein said electrical isolation means includes an optocoupler.

16. The timer circuit of claim 9, wherein said electrical isolation means includes a transformer.

17. The timer circuit of claim 9, wherein said electrical isolation means includes a mechanical relay.

18. The timer circuit of claim 9, wherein said power supply comprises a diode connected in series with a capacitor.

* * * * *